US005248186A

United States Patent [19]

Steinfeld et al.

[11] Patent Number: 5,248,186

[45] Date of Patent: Sep. 28, 1993

[54] BUMPER EDGE GUARD FOR UPHOLSTERED SEATING FURNITURE HAVING A CORE MEMBER

[75] Inventors: Manfred Steinfeld, Chicago, Ill.; Peter Barile, Naples, Fla.

[73] Assignee: Shelby Williams Industries, Inc., Morristown, Tenn.

[21] Appl. No.: 858,570

[22] Filed: Mar. 27, 1992

[51] Int. Cl.[5] ..... A47C 7/02

[52] U.S. Cl. ..... 297/452.1; 297/445; 248/345.1

[58] Field of Search ..... 297/183, 226, 445, 452, 297/463; 248/345.1

[56] References Cited

U.S. PATENT DOCUMENTS

| | | | |
|---|---|---|---|
| 2,932,120 | 4/1960 | Nacinovich | 248/345.1 |
| 3,291,529 | 12/1966 | Straits | 297/445 |
| 3,358,725 | 12/1967 | Bussaud et al. | 248/345.1 X |
| 4,106,739 | 8/1978 | Gasser | 248/345.1 |
| 4,106,739 | 8/1978 | Gasser | 248/345.1 |
| 5,118,162 | 6/1992 | Saul | 248/345.1 X |

FOREIGN PATENT DOCUMENTS

| | | | |
|---|---|---|---|
| 1963343 | 6/1971 | Fed. Rep. of Germany | 297/452 |
| 646148 | 11/1928 | France | 297/445 |

*Primary Examiner*—Laurie K. Cranmer

*Attorney, Agent, or Firm*—Silverman, Cass & Singer, Ltd.

[57] ABSTRACT

A chair having a seat portion connected to a backrest portion which are to be upholstered and an edge guard for the perimetric edges of the backrest portion including a substantially rigid support member for providing structural support to the backrest portion, a transparent substantially flexible tube positioned about the perimetric edges of the support member and having an interior channel therein, a core member positioned within the interior channel of the tube, a transparent substantially flexible protective member positioned over the tube and a first fastening member for securing the protective member to the support member with the tube being captured therebetween so that the core member is visible through the tube and the protective member.

9 Claims, 2 Drawing Sheets

BUMPER EDGE GUARD FOR UPHOLSTERED SEATING FURNITURE HAVING A CORE MEMBER

BACKGROUND OF THE INVENTION

1. Field of the Invention

This invention relates generally to edge guards for the backrest portions of upholstered seating furniture, and more particularly to a chair backrest including a transparent edge guard installed along the perimetric edges of the backrest having a layered construction which provides enhanced cushioning and stability of the edge guard with respect to the backrest. The edge guard includes a core member which provides cushioning and is visible through the edge member and can have a desired color and/or pattern which matches or complements the fabric covering the remainder of the backrest and which can be utilized with a handle to assist in grasping and moving the chair.

2. Description of the Related Art

Edge guards for seating furniture typically include some type of bumper member which is installed about the perimetric edges of the backrest to protect the fabric about the edges of the backrest from wearing against another object, such as a wall or the like. An example of such an edge guard is disclosed in U.S. Pat. No. 4,106,739 which discloses a continuously hollow edge member to be applied to the edges of the structural portions of a chair to protect and finish the same. The edge member can carry accent color through the hollow center section if desired as the material from which the bumper edge member is formed may be transparent, translucent or of any color desired. Such an edge member, however, is unsightly and merely changing the color of that edge member does little to enhance its decorative appearance. Additionally, due to its stiff and bulky one-piece design, such an edge member can be difficult to install about a corner of a chair without any bulges or wrinkles. Alternatively, if the edge member is made to be more thin and flexible, it would be susceptible to tearing during use.

It therefore would be desirable to provide an edge guard of layered construction which not only provides enhanced cushioning and stability of the edge guard with respect to the edges of seating furniture, but further provides a decorative appearance to the edge guard, the design and color of which can be altered as desired to match or complement the fabric covering the remainder of the seating furniture which readily can be installed about a chair corner and includes a handle to assist in grasping and moving the chair.

SUMMARY OF THE INVENTION

The invention provides a chair having a seat portion connected to a backrest portion which are to be upholstered and an edge guard for the perimetric edges of the backrest portion. The chair includes a substantially rigid support member for providing structural support to the backrest portion and a transparent substantially flexible tube positioned about the perimetric edges of the support member and having an interior channel therein. A core member is positioned within the interior channel of the tube and a transparent substantially flexible protective member is positioned over the tube. A first fastening member is included for securing the protective member to the support member with the tube being captured therebetween so that the core member is visible through the tube and the protective member.

DESCRIPTION OF THE PREFERRED EMBODIMENTS

Figure 1:
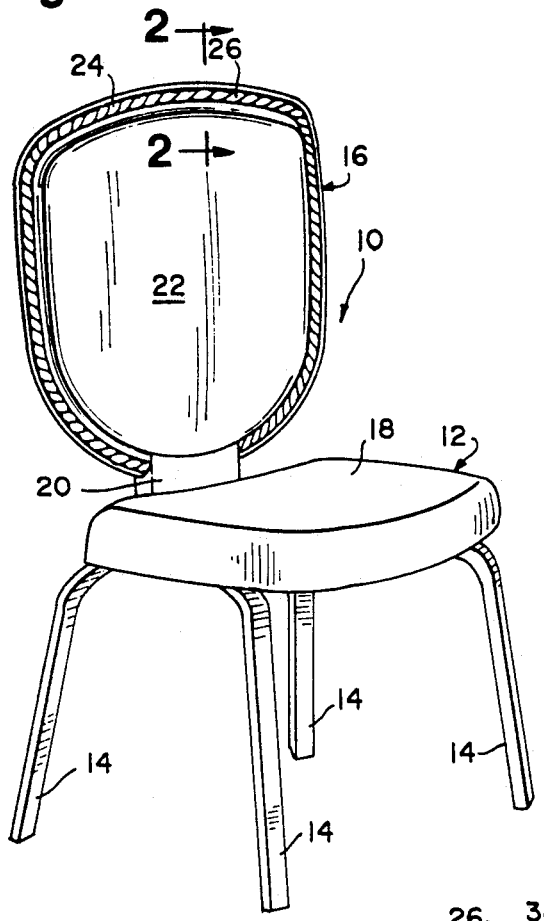
FIG. 1 is a perspective view of an upholstered chair having the edge guard embodying the invention secured about the edges of the backrest thereof.

Referring to FIG. 1, an upholstered piece of furniture, such as a chair, including the edge guard of the invention is designated generally by the reference numeral 10. The chair 10 preferably is an upholstered chair including a seat 12 having depending legs 14 and a backrest portion 16.

The seat 12 preferably is a padded seat having a foam and/or spring padding (not illustrated) which is covered with a desired piece of upholstery 18. It is to be understood, however, that the construction of the seat 12 can be modified and, if desired, can be unpadded.

The legs 14 are secured to the bottom of the seat 12 and can be constructed independently or can be formed by a pair of like inverted U-shaped members, each providing a pair of legs 14. The fastening of the legs 14 to the seat 12 as well as the specific design and material used for the legs 14 can vary.

The backrest portion 16 is secured to the seat 12 by a connecting member 20 which preferably is somewhat flexible so that the backrest portion 16 can flex backward during use. The backrest portion 16 includes an interior portion 22 and a perimetric edge 24 which includes an edge guard designated generally by the reference numeral 26 secured therearound.

Figure 2:
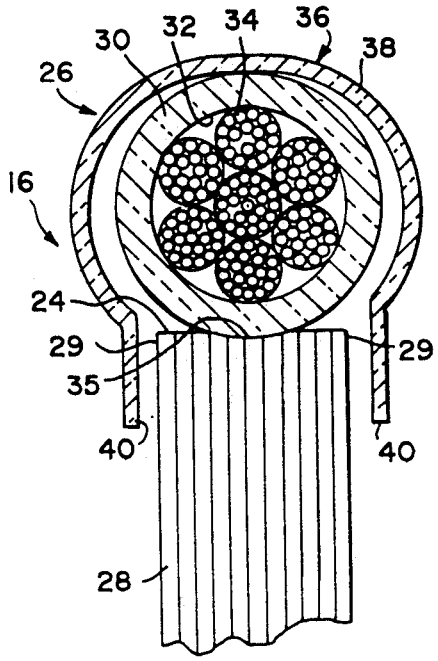
FIG. 2 is a cross-sectional view of the edge guard taken along the line 2—2 of FIG. 1 and in the direction indicated generally.
Figure 3:
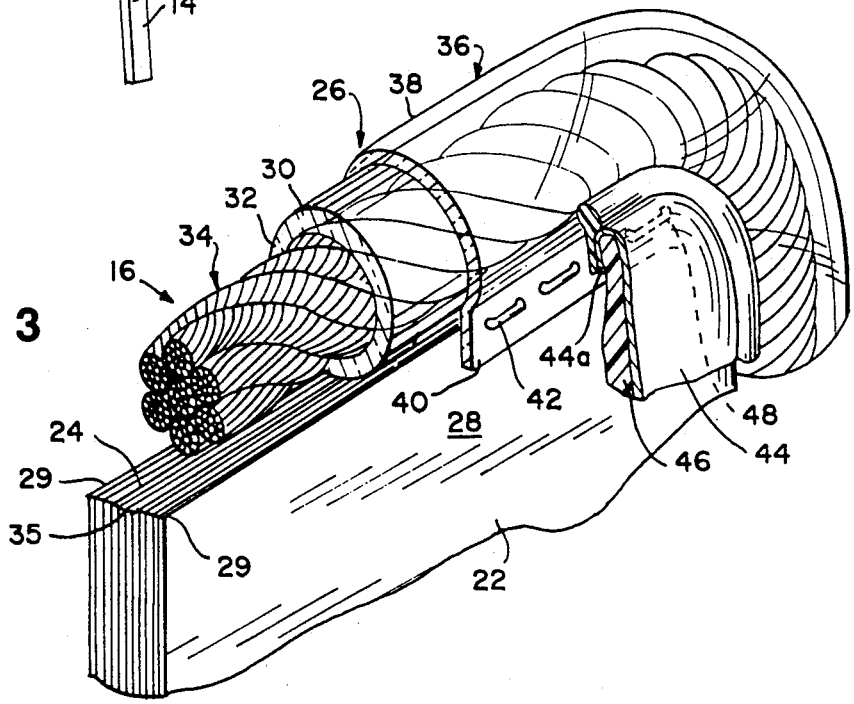
FIG. 3 is a fragmentary sectional perspective view of the edge guard of the invention illustrating its connection to the backrest.

As FIGS. 2 and 3 illustrate, the backrest portion 16 is constructed from a rigid support member 28 which preferably is made of plywood or similar material. Due to the thickness of the support member 28, two edges 29 are provided about the support member 28. The thickness as well as the size, shape and material utilized for the support member 28 can vary.

The edge guard 26 is positioned about the perimetric edge 24 and covers the edges 29 of the support member 28 and includes a substantially annular, transparent, flexible, hollow tube member 30. Preferably, the tube member 30 includes a hollow interior channel or core 32 having a functional and decorative core member 34 placed therein. In order to seat the tube member 30 with respect to the support member 28, the support member 28 can include a semi-circular recess 35 formed therein having a radius substantially corresponding to the exterior radius of the tube member 30.

The tube member 30 preferably is formed from extruded clear, flexible vinyl, but can vary. The core member 34 preferably provides a cushion to the edge guard 26 and is formed as a stranded fiber or rope member which is threaded through the interior core 32 and can be of any desired color. Alternatively, the core 34 can be formed of any type of material with any type of pattern or color, if desired.

To cover and secure the tube 30 and the core member 34 to the support member 28, the tube 30 is covered by a substantially transparent flexible protective member 36. The protective member 36 preferably is formed with somewhat of a mushroom shaped cross-sectional configuration from extruded clear, flexible vinyl and includes an elliptical shaped portion 38 and an open base with opposing depending flanges 40 integrally formed with the elliptical portion 38. When assembled, the elliptical portion 38 accepts the tube 30 and core member 34 therein and the flanges 40 are secured to opposite sides of the support member 28 by fasteners 42, such as staples, tacks or the like.

The protective member 36 substantially is clear so that the design or color of the core member 34 is visible therethrough. The flexibility of the protective member 36 is necessary so that the protective member 36 can be pulled tightly over the core member 34 and around a corner of the support member 28 without any bulges or wrinkles.

As FIG. 3 illustrates, in order to finish the remaining area of the support member 28 to form the finished backrest potion 16, a piece of fabric 44 and corresponding padding member 46 can be positioned within the interior portion 22 of the backrest portion 16 and fastened to the support member 28. The edges of the fabric 44 preferably cover the fasteners 42 of the protective member 36 and can be secured by additionally fasteners, such as staples 48, which also are covered by doubling over the edges of the fabric 44 and are not visible from the exterior of the backrest portion 16.

For example, the outer edge 44*a* of the fabric 44 first can be secured, with its interior side facing outward, to the support member 28 through the protective member 36 by staples 48, illustrated in dotted outline in FIG. 3. Thereafter, the padding 46 is positioned and the fabric portion 44 is turned down over the padding 46 and the fasteners 42 and 48 to conceal them from view from the exterior of the backrest portion 16. This upholstering continues about the periphery of the support member 28 to the bottom of the support member 28. At this point, the edges of the fabric member 44 are joined in a concealed manner, such as by sewing, with a fastener, an adhesive or the like, including any type of blind fastener such a a hook-and-loop or similar type of fastener.

To assemble the edge guard 26 to the chair 10, the tube 30, preferably with the core member 34 therein, is positioned within the recess 45 about the perimeter of the support member 28 and, if desired, can be held in place with an adhesive or fastener. Next the protective member 36 is positioned over the tube 30 and secured to the support member 28 at intervals therearound with the fasteners 42. This procedure can be accomplished a small amount at a time about the periphery of the support member 28 as the fasteners 42 are inserted or the entire tube 30 and protective member 36 first can be positioned and held together in position on the support member 28 and the fasteners 42 inserted all at once. Regardless, after the fasteners 42 are inserted the fabric portion 44 and padding 46 are installed as described above. If desired, a welt or rib (not illustrated) can be positioned between the interface of the fabric portion 44 and the protective member 36 the welt preferably being secured by the fasteners 48 when the fabric portion 44 is attached or with separate fasteners.

Figure 4:
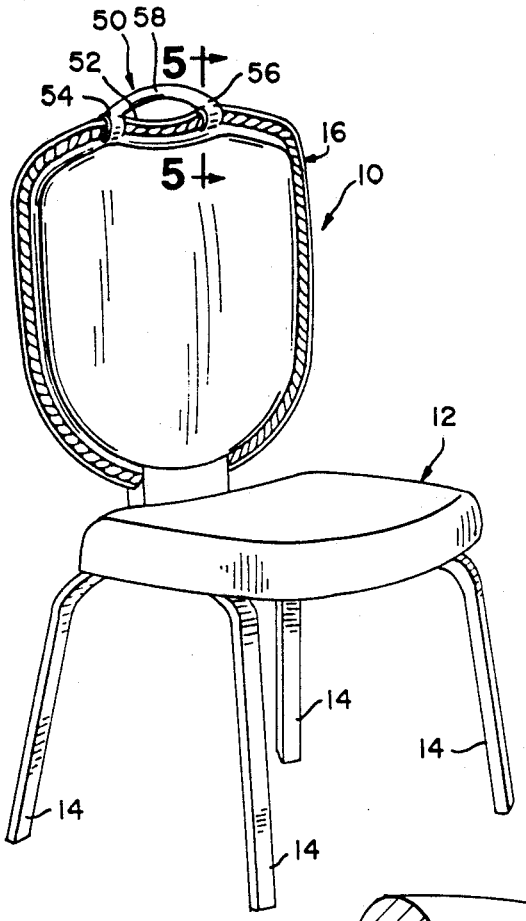
FIG. 4 is a perspective view of an upholstered chair illustrating a handle member utilized in conjunction with the backrest and edge guard of the invention.
Figure 5:
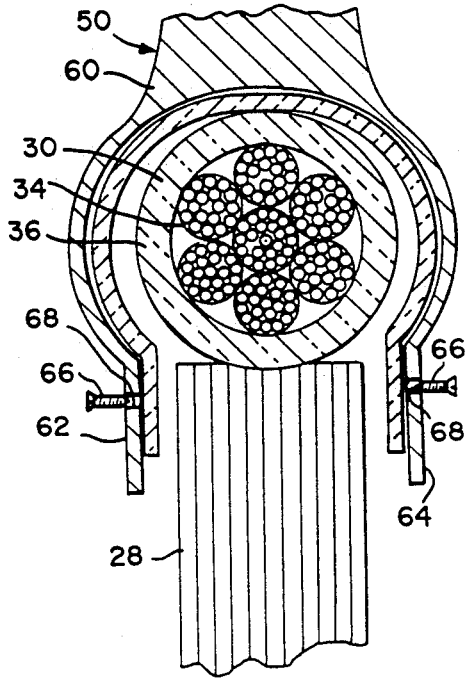
FIG. 5 is a cross-sectional view of the edge guard and handle taken along the line 5—5 of FIG. 4 and in the direction indicated generally.
Figure 6:
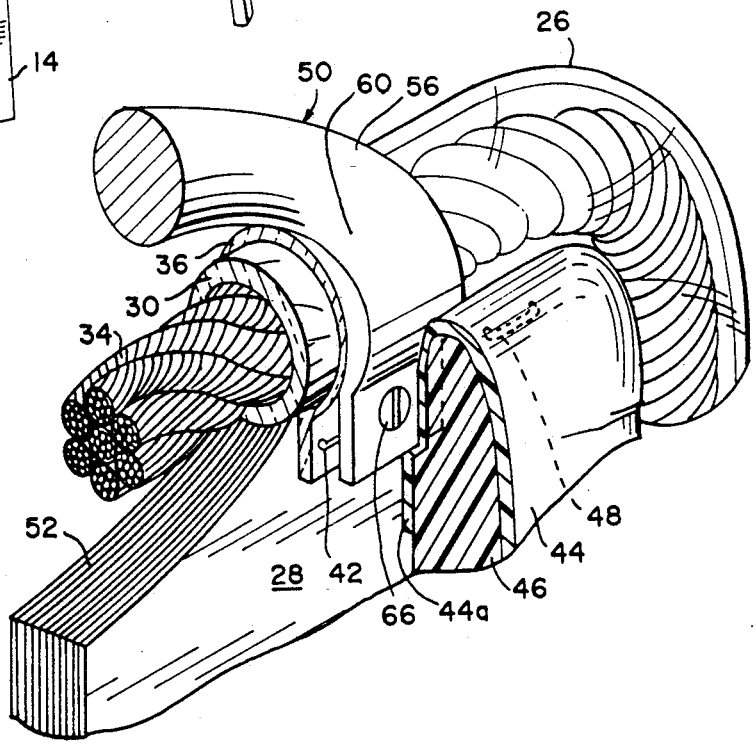
FIG. 6 is a fragmentary sectional perspective view of the edge guard and handle member of the invention illustrating their connection to the backrest.

FIGS. 4–6 illustrate another embodiment of the invention where common elements have been identified by similar reference numerals. In this embodiment, a handle 50 is included attached to the support member 28 of the backrest portion 16 which can include a recess 52 along the midpoint of its top edge to assist in gripping of the handle 50.

As FIG. 4 illustrates, the handle 50 includes first and second opposite ends 54 and 56 interconnected by a body portion 58. The ends 54 and 56 substantially are identical and each end includes a saddle portion 60, illustrated in FIGS. 5 and 6, formed by opposite legs 62 and 64. The legs 62 and 64 are inserted over the edge guard 26 and are connected on opposite sides of the support member 28 by fasteners, such as screws 66 which extend through apertures 68 formed in each leg 62 and 64, the apertures 68 either being pre-formed or formed by the screws 66 when fastened.

Preferably, the handle 50 is connected to the support member 28 after the edge guard 26 is installed. FIG. 5, however, generally illustrates mounting of the handle 50 as the protective member 36 is being installed. FIG. 6 illustrates the positioning of the fabric portion 44 which, as in the embodiment of FIGS. 1–3, covers the screws 66 as well as the other fasteners 42 and 48 to provide the desired finished affect to the chair 10. Additionally, a welt member (not illustrated) can be utilized if desired.

The handle 50 provides a strong, convenient member for gripping and moving the chair 10 which is easy to assemble without any visible fasteners and does not significantly detract from the appearance of the cord member 34 or the remainder of the edge guard 26.

Modifications and variations of the present invention are possible in light of the above teachings. For example, the edge guard 26 can be positioned on other portions of the chair 10, such as the seat 12, or on other types of upholstered or non-upholstered furniture or articles. It is therefore to be understood that within the scope of the appended claims the invention may be practiced otherwise than as specifically described.

What is claimed and desired to be secured by letters patent is:

1. A chair having a seat portion connected to a backrest portion which are to be upholstered and an edge guard for the perimetric edges of the backrest portion comprising:

a substantially rigid support member for providing structural support to said backrest portion;

a transparent substantially flexible tube positioned about the perimetric edges of said support member and having an interior channel therein;

a core member positioned within said interior channel of said tube;

a transparent substantially flexible protective member positioned over said tube; and first fastening means for securing said protective member to said support member with said tube being captured therebetween so that said core member is visible through said tube and said protective member.

2. The chair as defined in claim 1 including a handle member having first and second opposite ends, each end having engagement means for overlying a portion of said protective member, said tube and opposite sides of said rigid support member and including second fastening means on each of said first and second handle ends for securing said engagement means to said opposite sides of said rigid support member.

3. The chair as defined in claim 2 wherein said fabric portion further covers said second fastening means.

4. The chair as defined in claim 1 including a fabric portion for covering the remaining portion of said support member exterior of said protective member and for covering at least said first fastening means to provide a finished effect to said backrest portion of said chair.

5. The chair as defined in claim 4, including a welt member positioned about said fabric portion between said fabric portion and said protective member, said welt member being connected to said support member by third fastening means which are covered by said fabric member.

6. The chair as defined in claim 1 wherein said perimetric edges of said rigid support member are formed with a groove for seating of said tube therein.

7. The claim as defined in claim 1 wherein said core member substantially is resilient to provide cushioning for said tube.

8. The chair as defined in claim 7 wherein said core member is formed as a rope having a desired decorative color and/or pattern visible through said tube and said protective member.

9. A chair having a seat portion connected to a backrest portion which are to be upholstered and an edge guard for the perimetric edges of the backrest portion comprising:

a substantially rigid support member for providing structural support to said backrest portion, said support member including a groove formed about the perimetric edges of said support member to a predetermined depth;

a transparent substantially flexible tube positioned about the perimetric edges of said support member and seated within said groove, said tube including a hollow circular interior channel formed therethrough;

substantially resilient core means positioned within said interior channel of said tube, said core means being formed as a rope having a desired decorative color and/or pattern visible through said tube and providing cushioning for said tube;

a transparent substantially flexible protective cover member positioned over said tube;

first fastening means for securing said protective member directly to said support member with said tube being captured therebetween so that said core means are visible through both said tube and said protective member;

a handle member having first and second opposite ends, each end including a saddle portion formed by opposing first and second leg members which extend over said perimetric edge of said support member with said protective member, said tube and said core member being captured therebetween; and second fastening means for securing each of said first and second leg members of each saddle portion directly to said rigid support member.

* * * * *